United States Patent [19]

Baumgartner et al.

[11] 3,934,555

[45] Jan. 27, 1976

[54] BOILER USING COMBUSTIBLE FLUID

[75] Inventors: Henri Baumgartner, Bernex, Geneva; John G. Meier, Geneva, both of Switzerland

[73] Assignee: Battelle Memorial Institute, Switzerland

[22] Filed: July 3, 1974

[21] Appl. No.: 485,623

[30] Foreign Application Priority Data

July 11, 1973 Switzerland ..... 10085/73

[52] U.S. Cl. ..... 122/225 R; 122/136 R; 431/173

[51] Int. Cl.[2] ..... F22B 25/00

[58] Field of Search ..... 122/134, 136, 210, 223, 122/225; 431/173

[56] References Cited

UNITED STATES PATENTS

| | | | |
|---|---|---|---|
| 2,038,122 | 4/1936 | Olsen | 122/225 |
| 2,136,175 | 11/1938 | Waudby | 122/210 |
| 2,278,699 | 4/1942 | Jorolemon | 122/225 |
| 2,370,145 | 2/1945 | Carter | 122/136 |
| 2,560,076 | 7/1951 | Bloomer | 431/173 X |
| 3,048,215 | 8/1962 | Huckabee | 431/173 X |
| 3,080,119 | 3/1953 | Shutkufski | 237/66 |
| 3,187,726 | 6/1965 | Van Der Meulen | 122/149 |
| 3,434,660 | 3/1969 | Brumme et al. | 237/66 |
| 3,676,060 | 7/1972 | Bedetti | 431/173 X |

*Primary Examiner*—Kenneth W. Sprague
*Attorney, Agent, or Firm*—Robert E. Burns; Emmanuel J. Lobato; Bruce L. Adams

[57] ABSTRACT

A modular boiler having a cylindrical combustion chamber made of three modules and a module comprising a cover and a module comprising an expansion vessel mounted coaxially on the boiler adjacent the combustion chamber at opposite ends thereof. The cover has a frustro-conical configuration with the inner walls thereof diverging from an opening in the cover toward the interior of the combustion chamber at an angle of between 15° and 55°. The combustion chamber is formed of three castings that define the cylindrical combustion chamber and six axial hot gas flow paths spaced circumferentially from each other and disposed axially of and radially of the combustion chamber. Hot gases from the downstream end of the combustion chamber are recirculated to the upstream end of the combustion chamber to improve the combustion. Hot gas is diverted from these hot gas flow paths and flowed spirally of these flow paths along axially spaced flow paths immersed in the water circuit of the boiler to improve heat transfer. Liquid fuel is fed into the combustion chamber from a burner at the opening of the cover. The fuel is mixed with air to which a rotation has been imparted about the axis of the arrangement and entering the opening of the cover. The cover is jacketed and the jacket defines part of the inlet cold water circuit and the heated hot water circuit.

4 Claims, 6 Drawing Figures

IV
II
III
θ

BOILER USING COMBUSTIBLE FLUID

BACKGROUND OF THE INVENTION

This invention relates to boilers and more particularly to a new and improved modular boiler.

The combustion chamber of a boiler is closed by a cover to which the burner is fastened. This cover is formed by a cast iron plate which is generally solid. When the gases or the gas-liquid mixture is introduced into the combustion chamber with a slight turbulent movement, a dead eddy is formed at the corner formed by the sidewall of the chamber and the cover. This dead eddy increases the total loss in the head of the boiler and decreases the transfer of heat by radiation by forming a screen between the flame and the wall of the cover. This is why the cover is generally solid, as there is no reason to provide water circulation at this point of the combustion chamber.

The presence of the dead eddy is also harmful to the stability of the flow of the gases in the combustion chamber and to the flame itself.

SUMMARY OF THE INVENTION

An object of the present invention is to remedy the drawbacks of the aforementioned solutions, at least in part. For this purpose, the present invention relates to a fluid fuel boiler comprising a combustion chamber formed of sidewalls, a bottom, and a cover which has an opening for a burner shaped to impart the mixture introduced into said chamber a pre-rotation coaxial to said opening, a water circulation circuit surrounding said chamber and connecting a source of cold water to a hot water collector, and a burned-gas circulation circuit in contact with the water circulation circuit and connecting the combustion chamber to at least one exhaust collector. This boiler is characterized by the fact that the cover is shaped in such a manner as to form the wall of the chamber, gradually flaring out from the opening towards the inside of the chamber, forming an angle with the axis thereof of between 15° and 55°, and by the fact that the wall of the cover is hollowed and communicates on the one hand with the source of cold water and on the other hand with the hot water collector.

Although in the following description the cover to which the present invention more particularly relates is associated with a boiler of a specific type which forms the object of other inventions, it should be pointed out that this cover may be used with any type of known boiler, providing said boilers with the same advantages as those enumerated in the following description. It is, for example, obvious that the invention applies to boilers which do not have an expansion vessel.

BRIEF DESCRIPTION OF THE DRAWINGS

The accompanying drawing shows, by way of example, one embodiment of the boiler forming the object of the present invention.

DESCRIPTION OF THE PREFERRED EMBODIMENTS

Figures 1, 6:
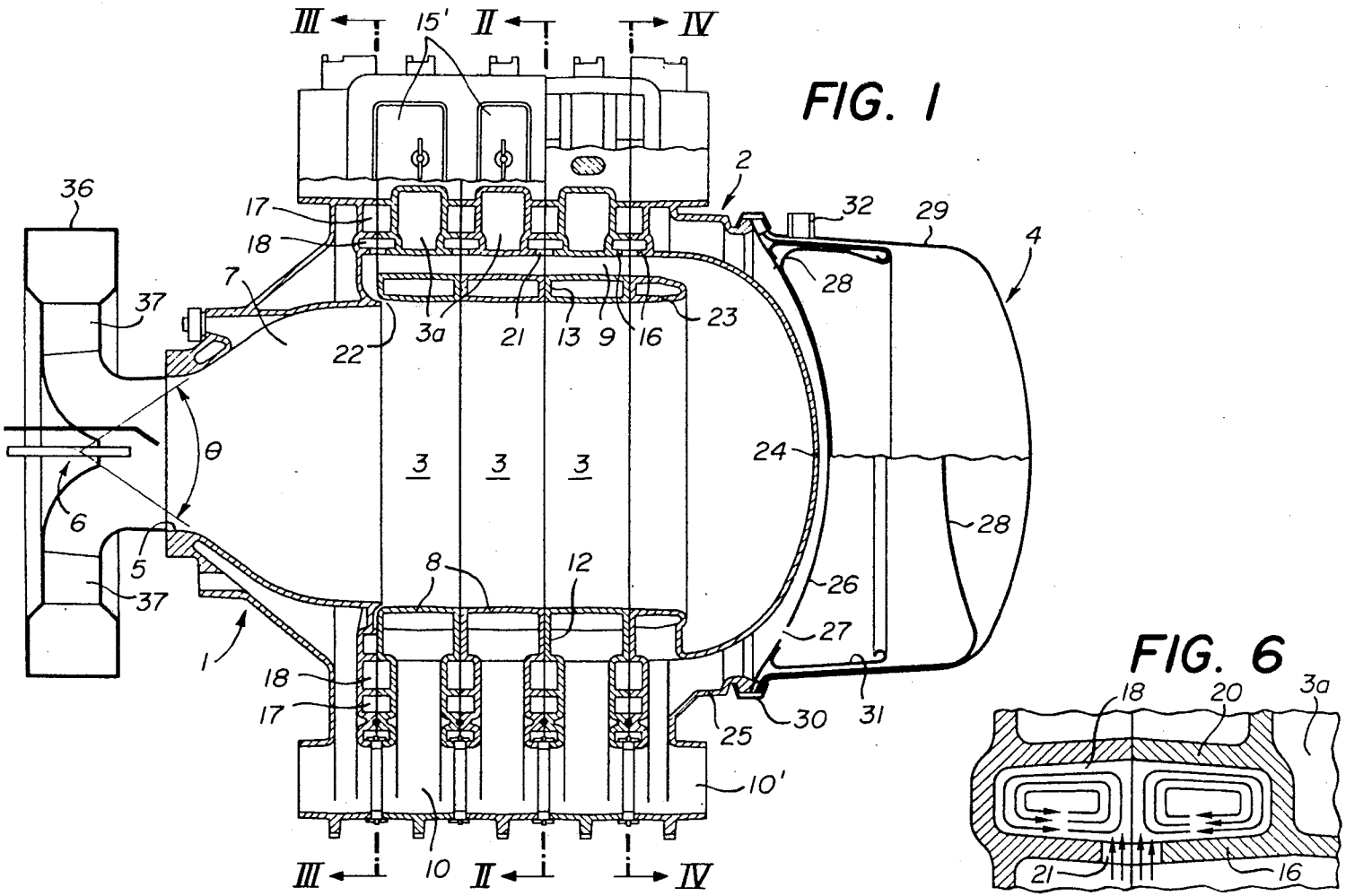
FIG. 1 is a sectional view along the section line I—I of FIG. 2.
FIG. 6 is a sectional view through a convection duct shown on a larger scale, in which the secondary movements of the gaseous mixture have been shown.

The boiler shown in FIG. 1 is a modular boiler which comprises a hollow cover 1, a bottom 2, three intermediate elements 3, and an expansion vessel 4 fastened to the bottom 2. The cover 1 has an opening 5 adapted to receive a burner 6. This opening 5 communicates with a combustion chamber 7 formed by the inner walls of the cover 1 and of the bottom 2 as well as by the central openings 8 provided through each of the intermediate elements 3. The inner wall of the cover 1 has a shape whose aerodynamic properties have been designed for a purpose which will be explained further below.

The bottom of the boiler, which closes off the combustion chamber 7, gives access to six ducts 9 having the shape of annular segments, which are concentric to the longitudinal axis of said chamber 7.

Figure 2:
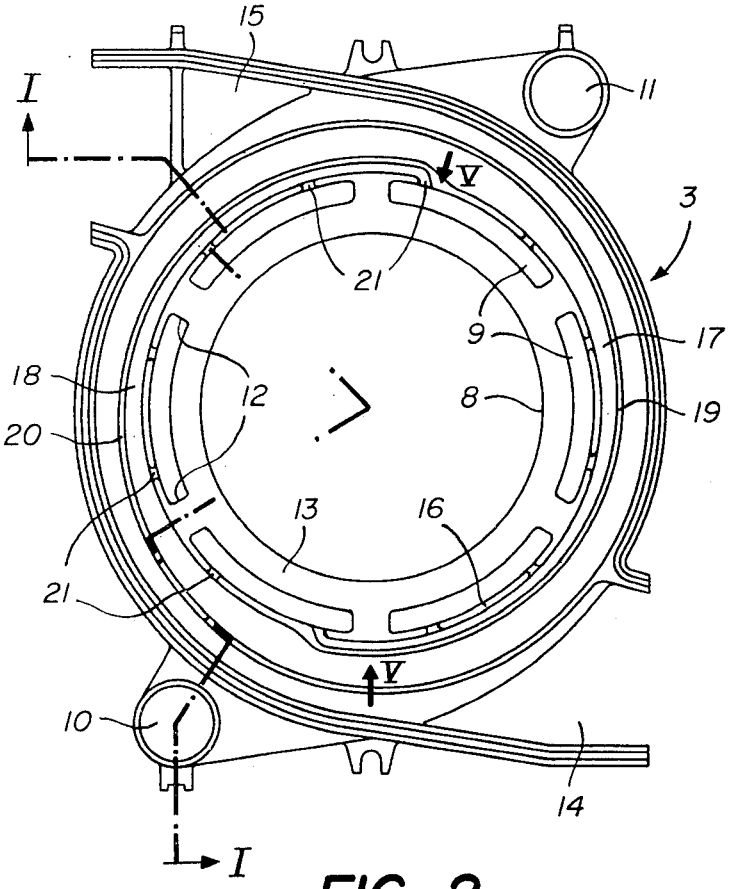
FIG. 2 is a sectional view along the section line II—II of FIG. 1.

Before describing the boiler in further detail, we shall describe an intermediate element 3, with reference to FIG. 2. This element, shown in plan view, is of generally annular shape. On this element there can be noted the central opening 8 as well as the six ducts 9. The opening 8 and the ducts 9 pass through the element 3 which extends between two parallel planes perpendicular to the axis of the opening 8. This element is a hollow cast iron body produced by casting. The inner space **3*a* (FIGS. 1 and 5) of this hollow element communicates with two openings 10 and 11 which are diametrically opposite each other with respect to the opening 8 and pass through the element 3 parallel to the axis of the central opening 8. The opening 10 is connected to the cold water feed circuit while the opening 11 is connected to the hot water distribution circuit. Six radial segments 12 provided between the ducts 9 connect the body of the element 3, that is to say the portion located outside the ducts 9, to an inner ring 13 which surrounds the central opening 8. These radial segments 12 and the ring 13 are hollow on the inside so that they communicate with the inner space 3*a* located at the periphery of the ducts 9**.

As shown in FIG. 1, the ring 13 extends over the entire width or length of the intermediate element 3 so that these rings 13 are assembled alongside of each other. This is not true of the portion of these elements 3 which extends along the periphery of the ducts 9. In this portion, the hollow space does not extend over the entire width or length of the element, the rest of this width or length being occupied by the three ribs 16, 19 and 20 provided on each of the two faces of the element and intended to form convection conduits 17 and 18 between the ducts 9 and the exhaust gas collectors 14 and 15 respectively which are diametrically opposite each other with respect to the axis of the combustion chamber 7. These collectors are closed by covers only some of which, 15', are visible in FIG. 1. As can be seen from this figure, the convention conduits 17, 18 alternate with the inner spaces **3*a* of the elements 3**.

If one refers again to FIG. 2, it will be noted that the provision of the conduits 17 and 18 is obtained by means of two spiral ribs 19 and 20 which are 180° apart from each other and extend around a circular rib 16 forming the periphery wall of the ducts 9. Each of these ducts is connected to the conduits 17 or 18 or even to both of these conduits by two injection nozzles 21 extending over a portion of the length of the conduit, for the purposes which will be explained subsequently.

Figure 3:
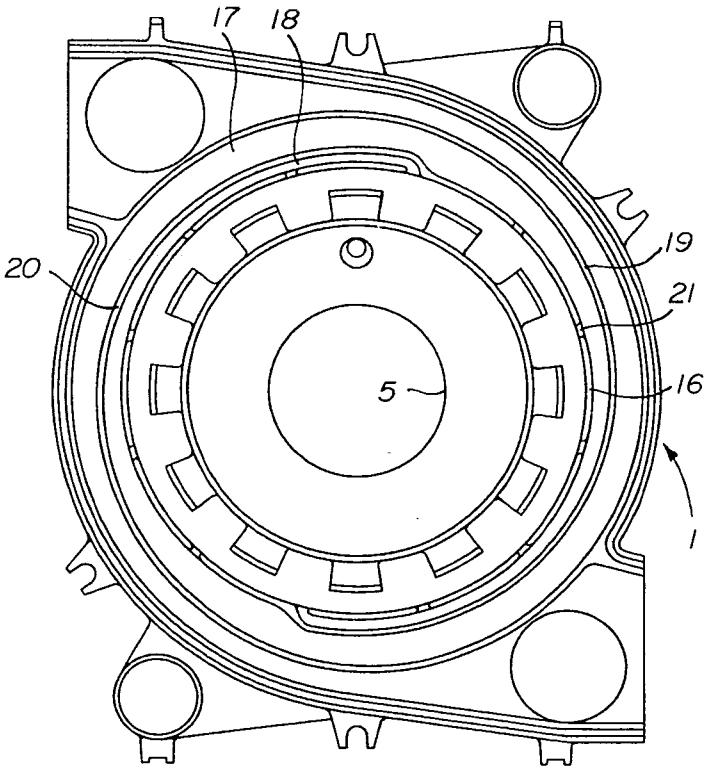
FIG. 3 is a sectional view along the section line III—III of FIG. 1.

From FIGS. 1 and 3 it can be noted that a series of spaces 22, distributed over the same circumference, is formed between the cover 1 and the inner ring 13 of the modular element 3 adjacent the cover. These spaces 22 cause the downstream ends of the ducts 9 to communicate with the combustion chamber 7, so as to permit the reinjection of a certain amount of hot gases upstream in the combustion chamber and better balance the pressure in the ducts 9. The temperature of the burned gases thus becomes more uniform in these ducts, so that the heat transfer is better distributed. This reinjection favors blue-flame combustion which gives better efficiency and is less noisy than yellow-flame combustion.

This film of gas is thus reinjected along the wall of the chamber 7 in a zone which is particularly exposed by virtue of the temperature of the flame. As the reinjected gases are not as hot as the flame, they form a protective film locally. This is of particular importance when the boiler is provided with a cover such as that shown, which, as will be seen subsequently, causes the flame to hug the wall of the chamber. In this case, particularly if the boiler is powerful and has numerous intermediate elements 3, it is advisable that the film of reinjected gas at least partially prevent the flame from coming into contact with this wall and make it possible to avoid reactions between the flame and the carbon of the cast iron of the walls of the combustion chamber.

Finally, the internal recirculation of the burned gases causes a diluting of the gases in the boiler and leads to a reduction in the rate of formation of $NO_x$.

The bottom 2 of the boiler also has an inner ring 23. The six ducts 9 having the shape of annular segments, commence between said ring 23 and the wall 24 which closes off the chamber 7. Like the other rings 13, the ring 23 communicates on the one hand with an opening 10' and on the other hand with an opening 11'. These openings are located in the extension of the openings 10 and 11 respectively, thus forming a conduit for the distribution of cold water to the boiler and a hot water collector respectively.

The bottom 2 also has an annular wall 25 which extends around the wall 24 and creates a communication with the openings 10' and 11'.

This annular wall 25 is intended for the attachment of the expansion vessel 4. This expansion vessel 4 has a wall 26 provided with a small opening 27 and is fastened in airtight manner to the end of the annular wall 25 thus forming, except for the opening 27, a closed space between the walls 24 and 26. The expansion vessel also has a diaphragm 28 whose edges are clamped between the edge of the wall 26 and the edge of a receptacle 29. These three elements are assembled on the annular wall 25 by a fastening collar 30. A guide ring 31 is fastened to the back of the wall 26, concentrically to the sidewall of the receptacle 29, and constitutes a guide support when the diaphragm 28 is folded towards the wall 26. This expansion vessel 4 also has an opening 32 through the wall of the receptacle 29, which serves to introduce a fluid between the diaphragm 28 and the receptacle in order to exert a certain pressure on the diaphragm 28.

The burner 6 is mounted coaxially to the chamber 7. It has a spiral supply well 36 fastened in the opening 5 of the cover 1. This well 36 is provided with vanes 37 intended to impart a pre-rotation to the jet of recirculated gases and air entering the chamber 7, the well being connected to the recirculation device for the burnt gases (not shown), which is connected to one of the exhaust collectors 14 and 15.

In operation, the combustion gases produced in the chamber 7 penetrate into the six ducts 9 having a shape of annular segments and flow in the direction towards the cover 1. As they advance in the ducts 9, the combustion gases enter the spiral conduits 17 and 18 via the injection nozzles 21 provided through the circular ribs 16. These spiral conduits 17 and 18 guide the combustion gases towards the exhaust collectors 14 and 15 respectively. One of the collectors is connected to the stack while the other is connected to the burner by a recirculation circuit (not shown). As has already been stated, the downstream ends of the channels of the ducts 9 communicate with the combustion chamber 7 via spaces 22. Thus a part of the combustion gases is reinjected into the combustion chamber through the spaces 22. This reinjection, as well as the recirculation of the gases in the burner, assures blue-flame combustion.

Various works have shown the curvature effect of a conduit of a given length on the flow of a fluid in said conduit. This curvature effect causes secondary movements within the flow in a plane perpendicular to the direction of advance of the fluid. The arrows included in the sectional view of such a conduit, shown on a larger scale in FIG. 6, indicate the path of these secondary movements. Now, these secondary movements greatly increase the heat transfer between the fluid and the walls of the conduit. They come from the centrifugal effect caused by the curvature, which effect is substantial only if the Dean's number of the flow is greater than a certain maximum. This maximum is a function of the Prandtl (Pr) number of the fluid, given by the ratio of the kinematic viscosity of the fluid to the thermal diffusivity of this fluid. The Dean's number is defined by the formula:

$$De = Re \sqrt{\frac{D_H}{2 \times Rc}}$$

in which $Re$ is the Reynolds number of the flow $D_H$ is the hydraulic diameter of the duct $Rc$ is the radius of curvature of the duct.

By way of example, it may be stated that for a gas or a gaseous mixture in which Pr is of the order of 0.7, the minimum Dean's number which must be present in order for the secondary movements to be substantial is about 10. If $Pr$ is about 5 (as in the case of water) $De$ min is about 5 and if $Pr$ is about 30 (as in the case of a light oil), $De$ min is about 1.

The presence of injection nozzles 21, located along the inner face of the spiral convection conduits, has the effect of locally reinforcing these secondary movements by a factor which is a function of the difference between the velocities produced by the curvature, along the direction of the radius of curvature, and the velocity of injection. It can be said that if a flow of gas is injected through the nozzles extending through the inner face of the curvature (see FIG. 6) at a velocity 20 times greater than the secondary velocities produced by the curvature, the reinforcement factor of the curvature effects is of the order of 2, which is considerable.

The secondary movements effectively distribute the injected gases and make the temperature field at the periphery of the spiral duct more uniform. This results in a greater transfer of heat and a decrease in the thermal stresses in the metal.

It has been stated that the cross section of the different injection nozzles 21 decreases from nozzle to nozzle, in the downstream direction of the spiral convection conduits 17 and 18. This feature takes into account the losses in head present upon going from the upstream end towards the downstream end of these conduits and makes it possible to obtain uniform rates of flow for all of the injection nozzles.

Aside from the curvature of the convection ducts, the existence of the nozzles has several advantages, particularly the advantage of making the weight rate of flow uniform between the different elements 3 so that the last element will have substantially the same rate of flow as the first element, and moreover of maintaining an intense turbulence in the convection conduits, thus increasing the heat transfer coefficient, and finally of reinjecting hot gases into the gases which have already cooled down, which increases the average temperature of the gases and therefore the flow of heat transferred from the gases to the water.

One will also note the equiangular arrangement of the nozzles with respect to the longitudinal axis of the combustion chamber 7, which distributes the hot points in the metal uniformly, better distributing the thermal stresses.

Figure 5:
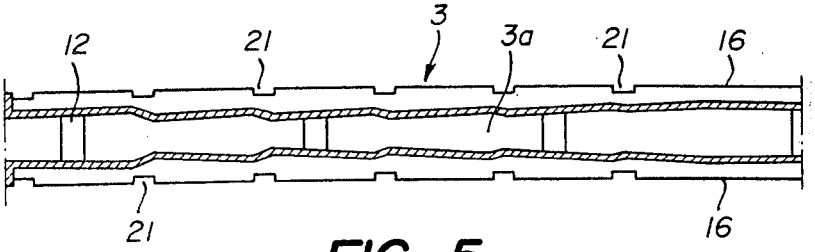
FIG. 5 is a developed view along the section line V—V of FIG. 2.
Figure 4:
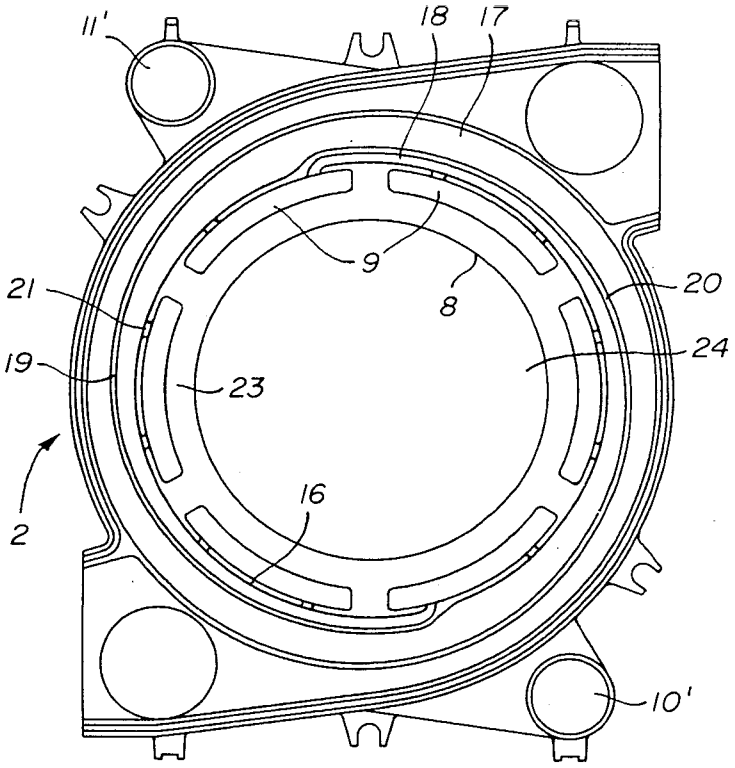
FIG. 4 is a sectional view along the section line IV—IV of FIG. 1.

It will furthermore be noted from FIG. 5 that the cross section of the convection ducts decreases from one nozzle 21 to the next, then increases suddenly again at each nozzle. This cross-section is selected so as to take into account the decrease in volume of the gases as a result of the cooling down thereof and the new conditions resulting from each reinjection. This cross-section is therefore calculated so as to maintain a substantially constant velocity of flow of the gases in the convection ducts.

While the combustion gases flow spirally in two separate streams between each element 3, the flow of the water takes place within these elements from the opening 10 to the opening 11. A part of the cold water entering into the inner space 3*a* of the intermediate elements 3 passes into the ring 13 via the radial segments 12 connecting the body of the element 3 to said ring.

Upon the placing in operation of the boiler, a certain pressure is created in the expansion vessel 4 between the receptacle 29 and the diaphragm 28 by introducing a gas under pressure through the opening 32, which is then hermetically closed. When the water is introduced, the pressure within the expansion vessel 4 is equalized via the opening 27. This arrangement of the expansion vessel is advantageous due to the fact that it makes it possible to integrate it in the boiler, thus forming a more compact installation.

During the course of the description mention has already been made of certain advantages of the boiler which is the object of the present invention. Still others may be mentioned which make is possible to solve many problems posed by the boilers today on the market.

Among such advantages, we may first of all mention the fact that the flow of the combustion gases between the ducts 9 and the collectors 14 and 15 takes place via convection conduits 17, 18, connected in parallel to the ducts 9. This arrangement of the convection conduits in parallel is extremely important due to the fact that it makes it possible to adapt the area of the cross-sections of passage of the combustion gases to the power of the boiler.

Each modular element is provided with two convection conduits 17, 18 which lead to two exhaust collectors 14 and 15, which makes it possible to effect the recirculation of the exhaust gases coming from one of the two collectors.

As can be noted particularly well from the cross-sectional views of the boiler, its geometry is symmetrical both with respect to the water, feed, and discharge conduits and with respect to the convection conduits and the exhaust collectors. This symmetry makes it possible to have uniformly distributed specific heat loads, thus avoiding strong internal stresses in the cast iron.

From these same cross-sectional views of the boiler it can also be seen that the second half of each convection conduit, located downstream of the nozzles 21 which discharge into said conduits, decreases in cross section as one approaches the exhaust collectors 14 and 15. As the cooling of the gases leads to a decrease in their specific volume, their absolute pressure remaining substantially constant, this decrease in cross-section makes it possible to make the velocity of these gases uniform and contributes to a good heat transfer. Turbulence generators (not shown) can also be placed in these conduits. This measure is however optional.

FIG. 1 shows that the ribs 16, 19 and 20 forming the convection conduits 17 and 18 constitute heat transfer vanes for the water circulation ducts.

It has been mentioned that the inner wall of the hollow cover 1 is of a special shape which, starting at the opening 5, provides a space of progressively increasing cross section of generally frusto-conical shape with an angle of between 30° and 110°. This cover 1 closes the combustion chamber 7 which is cylindrical. The conical portion connecting the opening 5 to the cylindrical chamber 7 is cooled by the circulation of water within the hollow cover. Moreover, the pre-rotation imparted to the feed gases by the vanes of the spiral well 36 imparts to these gases or to the gas-liquid mixture a turbulent movement which follows the conical portion of the cover. The value of the angle $\theta$ is selected as a function of the angular speed imparted to these gases or to the gas-liquid mixture. The inner shape of the cover 1 has the advantage of eliminating the dead eddyings which occur in the corners of boilers with flat covers. This conicity makes it possible to stabilize the flow and to elongate the flame, which spreads out on the periphery of the combustion chamber, located in the extension of the conical portion of the cover. The temperature of the flame is made more uniform and the volume of radiating burned gases is greater, which increases the heat transfer to the wall of the combustion chamber 7.

The elimination of the dead eddy which takes place in boilers with a flat cover at the corner between said cover and the combustion chamber, decreases the total loss in head of the boiler and increases the transfer of heat by radiation. This is due to the fact that the dead eddy is relatively cold and constitutes a screen against the radiation of the flame.

The suppression of this dead eddy therefore makes it possible to utilize the volume provided within the hollow cover in order to increase the total exchange surface of the boiler. Another reason for this circulation of water in the cover is that the water lowers the temperature of the surface of the cover. This cooling of the wall of the cover reduces the formation of nitrogen oxides $NO_x$ by the action of heat and reactions between the flame and the carbon of the cast iron of the cover.

We claim:

1. A fluid fuel boiler comprising, a combustion chamber, a cover on said combustion chamber having an opening for introducing a combustion supporting gaseous fluid through said opening, means to impart rotation to the gaseous fluid about an axis of said combustion chamber, a burner for introducing a fluid fuel into the chamber mixed with said gaseous fluid for combustion thereof, said cover having a generally frustro-conical configuration diverging from said opening toward the interior of said chamber at an angle of between 15° and 55°; means defining said combustion chamber having means defining a plurality of axial hot gas flow paths from a downstream portion of said combustion chamber to flow hot gases into an upstream portion of said combustion chamber, and means for diverting some of said hot gas flow along paths in a direction circumferentially of said combustion chamber, said latter paths being immersed in the flow path of said water thereby to improve heat transfer and terminating in a gas outlet, said combustion chamber comprising at least one modular element, joined axially to said frustro-conical cover and coaxial therewith, said modular element comprising an inner ring and said means defining said plurality of axial hot gas flow paths defining a plurality of axial flow paths disposed circumferentially spaced from each other and radially of each ring thereby radially of said combustion chamber, said modular element comprises said means diverting hot gas flow circumferentially of said combustion chamber, and the last-mentioned means comprising means defining a spiral flow path about each said ring.

2. A fluid fuel boiler according to claim 1, in which the spiral flow paths are disposed axially spaced on said combustion chamber, means defining nozzles for introducing gas flow from said axial hot gas flow paths into said spiral flow paths.

3. A fluid fuel boiler comprising, a combustion chamber, a cover on an end of said combustion chamber having an opening for introducing a combustion-supporting gaseous fluid through said opening, said cover having a generally frustroconical internal configuration with interior surfaces diverging from said opening and axis of the cover toward the interior of said combustion chamber at an angle of between 15° and 55°, means defining spiral flow paths for said gaseous fluid upstream of said opening of said opening of said cover to impart a swirl to said gaseous fluid as it enters through said opening and about a common longitudinal axis of said cover inner surfaces and said combustion chamber, said cover having a water jacket defining an annular space for water therein, the water jacket having interior surfaces diverging from said opening in a direction toward said combustion chamber so that said space is generally frustro-conical in configuration, and said water jacket having an inlet for cold water and an outlet for hot water, remote, from each other, whereby dead eddies in the flow of said gaseous fluid are eliminated and said cover is cooled to reduce the formation of nitrogen oxides.

4. A fluid fuel boiler according to claim 3, in which said cover is made of cast iron, and a burner is mounted coaxial with said opening for discharging fuel in the swirled gaseous fluid upstream of said opening.

* * * * *